United States Patent [19]

Simpson

[11] Patent Number: 4,884,589

[45] Date of Patent: Dec. 5, 1989

[54] COVER FOR COLLAPSIBLE SHELTER

[75] Inventor: David H. Simpson, Concord, Canada

[73] Assignee: Klein Tools Inc., Chicago, Ill.

[21] Appl. No.: 250,741

[22] Filed: Sep. 29, 1988

Related U.S. Application Data

[63] Continuation-in-part of Ser. No. 906,085, Sep. 11, 1986, abandoned, which is a continuation-in-part of Ser. No. 685,555, Dec. 24, 1984, Pat. No. 4,612,948.

[51] Int. Cl.[4] ..... E04H 15/58; E04H 15/64; E04B 1/12

[52] U.S. Cl. ..... 135/117; 135/119; 135/900; 52/63; 52/DIG. 12

[58] Field of Search ..... 52/63, 83, 222, DIG. 12, 52/DIG. 14; 135/117, 900, 901, 115, 119, 91, 92, 93, 94, 112, 95

[56] References Cited

U.S. PATENT DOCUMENTS

| | | | |
|---|---|---|---|
| 739,389 | 9/1903 | Castle | 135/117 X |
| 1,833,095 | 11/1931 | Smith | 135/119 X |
| 1,833,096 | 11/1931 | Smith | 135/117 X |
| 1,966,561 | 7/1934 | Ratta, Jr. | 135/900 X |
| 2,744,581 | 5/1956 | Cooper | 52/63 X |
| 3,323,530 | 6/1967 | Smith | 135/901 X |
| 3,452,764 | 7/1969 | Bell | 135/117 X |
| 3,609,905 | 10/1971 | Fuhrman et al. | 135/901 X |
| 3,623,765 | 11/1971 | Bowen | 135/117 X |
| 3,751,741 | 8/1973 | Hendry | 135/117 X |
| 3,799,608 | 3/1974 | Smutny et al. | 135/901 X |
| 3,800,814 | 4/1974 | Hibbert | 135/117 X |
| 3,847,170 | 11/1974 | Anderson | 135/119 X |
| 4,035,876 | 7/1977 | Takamatsu | 24/386 |
| 4,067,346 | 1/1978 | Husted | 135/901 X |
| 4,068,674 | 1/1978 | Mitchell | 135/117 X |
| 4,099,301 | 7/1978 | Fujisaki | 24/386 |
| 4,106,145 | 8/1978 | Gillen et al. | 135/901 X |
| 4,285,354 | 8/1981 | Beavers | 135/900 X |
| 4,612,948 | 9/1986 | Simpson | 135/112 |
| 4,716,919 | 1/1988 | Griffin | 135/901 X |

*Primary Examiner*—Robert A. Hafer
*Assistant Examiner*—D. Neal Muir
*Attorney, Agent, or Firm*—Ivor M. Hughes

[57] ABSTRACT

This invention relates to a portable self-supporting collapsible shelter having a supporting frame; a cover comprising a tent enclosure when erected and supported by the frame having at least two side walls spaced from each other at the same ends by a rear wall, a top wall (or roof) and a front wall; the cover having at least one continuous opening directed across one first wall and at least partially across two other walls spaced from each other at the same ends by the one first wall, in use said at least one continuous opening being closed and opened by at least one continuous closure mechanism being disengageable so as to open the at least one continuous opening and being engageable so as to close the at least one continuous opening, enclosing an article traversing the at least one continuous opening.

6 Claims, 9 Drawing Sheets

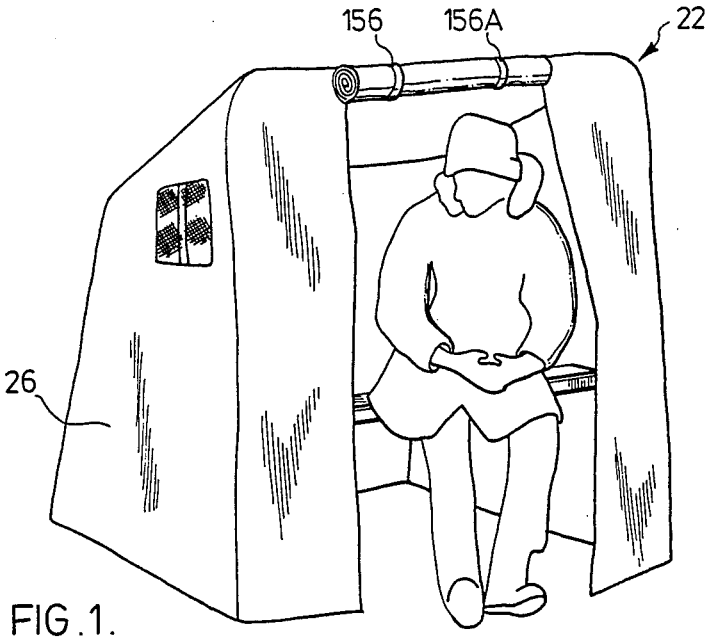
FIG. 1.
FIG. 2.
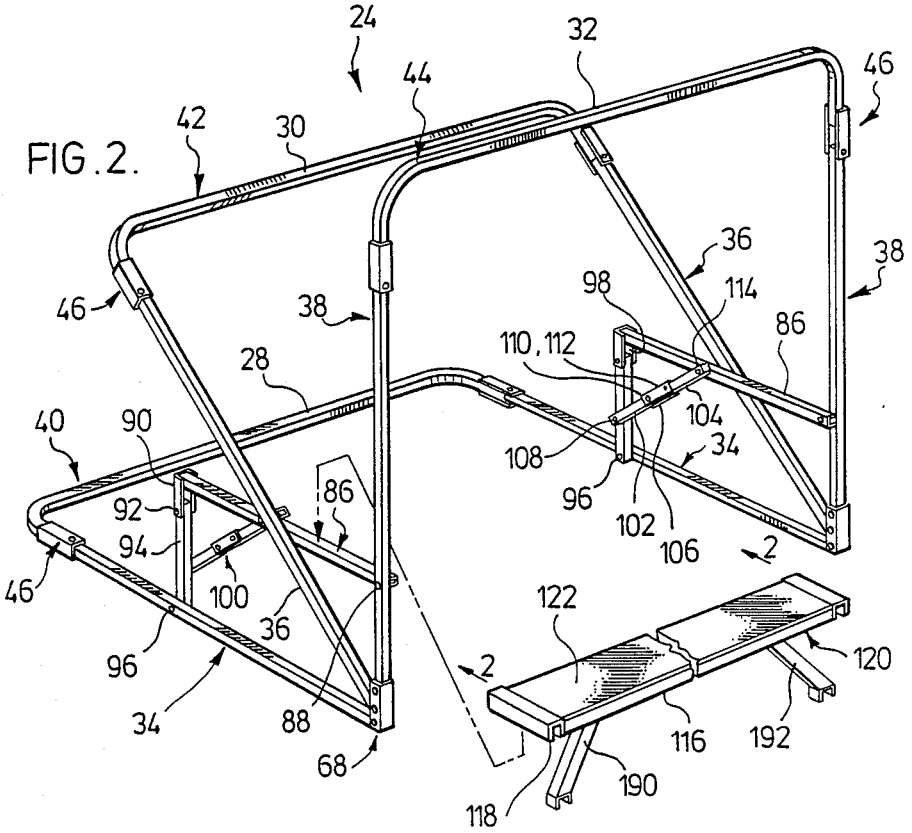

COVER FOR COLLAPSIBLE SHELTER

FIELD OF INVENTION

This Application is a continuation-in-part application of U.S. patent application Ser. No. 06/906,085, filed Sept. 11, 1986, now abandoned, which is a CIP of U.S. patent application Ser. No. 06/685,555 filed Dec. 24, 1984, now U.S. Pat. No. 4,612,948 issued 9-23-86.

This invention relates to a cover for a collapsible shelter.

BACKGROUND OF THE INVENTION

Tents in use through the world, may comprise an underlying or surrounding frame to shape or support a canvas or fabric shelter. In one aspect, the shelter of canvas or fabric is supported by underlying poles and stretched by cords secured to pegs driven into the ground; or, the underlying support may comprise a self-supporting framework around which the canvas or fabric is secured. In another aspect, the self-supporting framework may surround and suspend the canvas or fabric shelter. Existing tents require some degree of assembly of the constituent elements comprising the self-supporting framework or some degree of assembly in erecting the combination of fabric supported by underlying poles and stretched by cords secured to pegs driven into the ground. Until my invention, the assembly required has been time consuming and is not advantageous where a portable shelter is required which may be erected in a matter of seconds without requiring any assembly of its constituent elements. This is so, for example, in the case of field repairs by utility companies in environments where either the worker or the equipment must be protected from the elements by the migration of dust, corrosive contaminants, rain or snow etcetera . . . ; or, for example, where a hunting blind is usefully employed when it may be quickly and inconspicuously set up.

It is, therefore, an object of this invention to provide an improved portable shelter or tent enclosure which overcomes the deficiencies of prior art. Further and other objects of the invention will be realized by those skilled in the art from the following summary of the invention and detailed description of preferred embodiments thereof.

SUMMARY OF THE INVENTION

This invention relates to a portable shelter or tent enclosure having a self-supporting frame structure that may be pivotally erected and collapsed for supporting a fabric cover. The frame structure has a seat that is easily connected to and removed from the frame structure of the shelter which provides an effective lateral brace when connected to the frame. The portable shelter comprises a collapsible self-supporting frame, the shape of the frame when pivotally erected, defined by at least three substantially U-shaped frame members, each frame member having a pair of parallel side arms spaced from each other at the same end by a top arm sufficient to form a substantially U-shape, the top arm at either end carrying a channel in which one end of each side arm is pivotally linked sufficient to permit each side arm to be positioned at a substantially right angle to the top arm and to pivot to a position substantially parallel and adjacent to the top arm; the at least three substantially U-shaped frame members pivotally linked so as to define at least three planes, the at least three side arms spaced on each side of the at least three top arms, at their ends remote the top arm pivotally linked in at least two parallel spaced apart vertical channels, each channel providing at least two vertically spaced pivot points in which the end portions of the at least two side arms are vertically spaced and pivotally linked to each vertical channel, sufficient to permit the at least three substantially U-shaped frame members defining at least three planes to be spaceable from each other extending pivotally from common pivot points provided by the at least two parallel spaced apart vertical channels so as to provide a frame when pivotally erected having three frame members angularly spaced from a common line of pivot, the angularly spaced frame members comprising a first horizontal frame member, a third vertical frame member, and a second intermediate frame member angularly spaced between the first and third frame member; the at least three angularly spaced frame members when pivotally erected, releasably locked in spaced relationship by a releasable locking means comprising a horizontal locking segment pivotally attached to the vertical side arm of the third vertical frame member at a point spaced from the ends thereof, a vertical locking segment pivotally attached to the horizontal side arm of the first horizontal frame member at a point spaced from the end thereof, the horizontal locking segment carrying a vertically extending channel in which the end of the vertical locking segment is pivotally linked, at substantially a right angle when the frame is erected, a diagonal locking segment composed of two pivotally attached subsegments connected one to the other by an intermediate channel-shaped locking bar providing at least two spaced pivot points, extending downwardly at substantially 45 degrees between the vertical and horizontal locking segment so as to lock the position of the vertical locking segment at a substantially right angle to the horizontal locking segment, the said releasably locking means carried on both sides of the frame; and the frame further supported in spaced relationship by a removeably securable horizontal seat extending between and surmounting the horizontal locking segments, the seat carrying two lateral support arms each for extending between the seat and the side arms of the horizontal frame member so as to substantially stabilize the lateral stability of the frame.

In one embodiment of the invention, preferably the frame is constructed of aluminum.

According to another aspect of the invention, a canvas or fabric cover surrounds and is secured to the frame. In one embodiment of the invention, the cover when used in combination with the frame, is suitable for use as a portable hunting blind, providing a plurality of flaps, screens and windows suitable for camouflaging, comprising a front flap door spaced between the arms of the third vertical frame member, a plurality of apertures comprising windows, screens or flaps on the side, back or top of the hunting blind spaced between the angularly spaced side or top arms of the frame members.

Preferably, the screens comprise a fine webbing sewn into an aperture in the cover and are constructed of at least two overlapping pieces of webbing to provide slits which may be ideally spread apart by hand pressure or pressure from the muzzel of a firearm. Preferably, fabric flaps overlie the screens to make the aperture waterproof and may be rolled up to expose the screens.

According to another embodiment of the invention, the flaps may be secured in an opened or closed position by means of a zipper connected to the cover, or by means of fabric ties.

In another embodiment of the invention, the cover, when used in combination with the frame, is suitable for use in effecting electrical or telephone field repairs, particularly in the case of electrical components including integrated circuits or switches, fibre optics, cables or digital equipment where the equipment must be worked upon in a protected environment in order to be kept clean. According to this embodiment, a plurality of zippers, flaps, collars and the like are provided sufficiently that the portable tent enclosure may be erected so as to directly enclose the equipment or surround the equipment comprising a substantially horizontally placed zipper extending around the sides and back of the shelter so as to receive and enclose a cable passing longitudinally through the portable tent enclosure; and, further comprising a plurality of flaps extending from the top and sides of the portable tent enclosure proximate the third vertical frame member, the top flap providing at least one vertically extending collar sufficient to surround at least one vertically extending pole proximate its base and thereby form an enclosure about a pole. According to this embodiment of the invention, a pole carrying integrated circuits or switches or digital equipment in a box proximate its base may be enclosed to provide a controlled environment that will not expose the equipment to dust, corrosive contaminants, rain or snow etcetera.

It will be appreciated that the erected shelter may be collapsed to a portable position by removing the horizontal seat releasing the locking means, pivotally placing the third and second frame members in a horizontal position parallel the first horizontal frame member, and pivoting the side arms of each frame member inwardly to a position substantially parallel and adjacent to the corresponding top arm of each frame member. The canvas or fabric cover attached to the frame members substantially conforms to the dimensions of the collapsed frame.

Preferably, the cover is secured to the frame by means of loops passing around the frame members or, may be secured by means of bolts or pins passing through the cover and secured to the frame members.

In another embodiment of the invention there is provided for a portable self-supporting collapsible shelter having a supporting frame, a cover comprising when erected upon said frame a tent enclosure having at least two side walls, a top wall, and a front wall; the cover having at least one continuous openings slit directed across at least two adjacent walls, the at least one continuous opening slit when open providing a mouth having an upper lip and a lower lip which are separable and which extend to two remotely spaced edges of the mouth, the at least one continuous opening slit being closed and opened by closure means and preferably continuous closure means, the said mouth when open suitable to receive at least one section of a cable longitudinally passing through the tent enclosure, said at least one section of cable receivable into the said tent enclosure through the mouth to the extent of the two remotely spaced edges of the mouth, the closure means in use for joining the upper lip and the lower lip to proximate the two remotely spaced edges of the mouth sufficient to form two apertures, one aperture proximate each edge of the mouth; whereby in use the mouth is substantially closed by the closure means so as to enclose the at least one section of cable in the tent enclosure and form two apertures about the section of cable, one aperture proximate each edge of the mouth; and whereby the mouth may be opened to permit removal of the at least one section of cable from the tent enclosure.

In still yet another embodiment of the invention there is provided for a portable self-supporting collapsible shelter having a supporting frame, a cover comprising a tent enclosure when erected upon said frame and having at least two parallel side walls spaced from each other by an intermediate rear wall, a top wall, and a front wall; the cover having at least one continuous opening slit directed across at least two adjacent walls, the at least one continuous opening slit when open providing a mouth having an upper lip and a lower lip which are separable and which extend to two remotely spaced edges of the mouth, the at least one continuous opening slit being closed and opened by closure means and preferably continuous closure means, the said mouth when open suitable to receive at least one section of a cable longitudinally passing through the tent enclosure, said section of cable receivable into the said tent enclosure through the mouth to the extent of the two remotely spaced edges of the mouth, the closure means in use for joining the upper lip and the lower lip to proximate the two remotely spaced edges of the mouth sufficient to form two apertures, one aperture proximate each edge of the mouth; whereby in use the mouth is substantially closed by the closure means so as to enclose the at least one section of cable in the tent enclosure and form two apertures about the at least one section of cable, one aperture proximate each edge of the mouth; and whereby the mouth may be opened to permit removal of the at least one section of cable from the tent enclosure.

According to yet another aspect of the invention there is provided for a portable self-supporting collapsible shelter having a supporting frame, a cover comprising a tent enclosure when erected and supported by the frame having at least two preferably parallel side walls spaced from each other at the same ends by a rear wall, a top wall (or roof) and a front wall; the cover having at least one continuous opening directed across one first wall and at least partially across two other walls spaced from each other at the same ends by the one first wall, in use said at least one continuous opening being closed and opened by at least one continuous closure means preferably at least one zipper being disengageable so as to open the at least one continuous opening and being engageable so as to close the at least one continuous opening, enclosing an article traversing the at least one continuous opening.

The invention will now be illustrated with reference to the drawings of an embodiment of the invention.

DESCRIPTION OF THE DRAWINGS

FIG. 1 is a perspective view of a portable shelter in one embodiment of the invention.

FIG. 2 is a perspective view of a pivotally collapsible self-supporting frame for the portable shelter shown in FIGS. 1, 10 and 14, shown in an erected position.

DESCRIPTION OF PREFERRED EMBODIMENTS OF THE INVENTION

Figure 9:
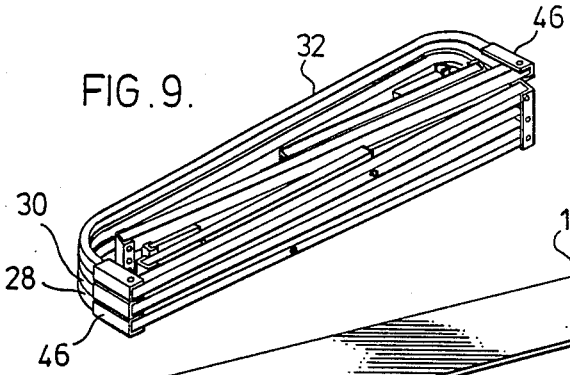
FIG. 9 is a perspective view of the frame shown in FIGS. 2, 7 and 8, in a fully collapsed position.

With reference to FIG. 1, a portable shelter or tent enclosure 22 is shown comprising a pivotally collapsible self-supporting frame 24 (best shown in FIG. 2) secured to a surrounding canvas or fabric cover 26.

With reference to FIG. 2, the frame 24, when pivotally erected is shown comprising a first horizontal frame member 28, a second intermediate frame member 30, and a third vertical frame member 32. Frame members 28, 30 and 32 each comprise a pair of parallel side arms 34, 36 and 38 spaced from each other by a top arm 40, 42 and 44 respectively. The top arm 40, 42 and 44 extending horizontally is curved at both ends to carry two vertically oriented pivotal joints 46 (best shown in FIGS. 3 and 4), pivotally linking side arms 34, 36, 38 and top arms 40, 42, 44 respectively.

Figure 3:
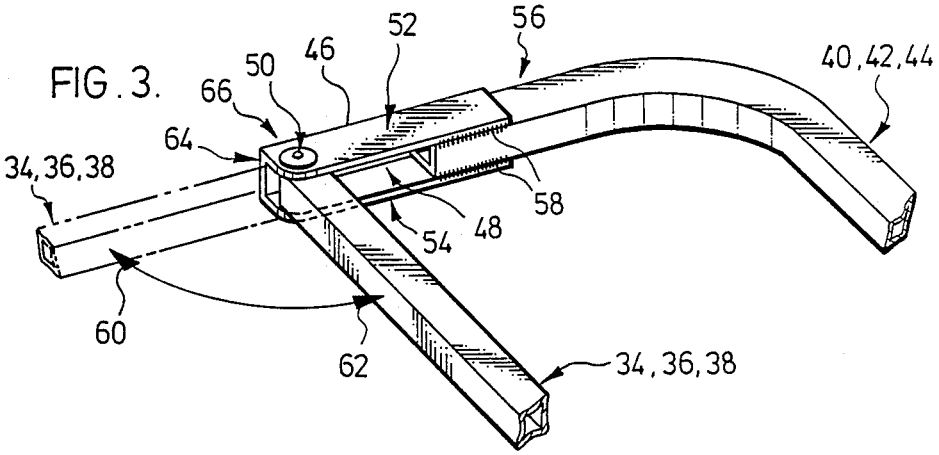
FIG. 3 is a close-up perspective partially cut away view of a pivotal joint for the frame shown in FIGS. 2, 7, 8 and 9, shown variably in an erected and a collapsed position.

With reference to FIG. 3, pivotal joint 46 is U-shaped and comprises a vertically oriented channel 48 opening inwardly towards top arms 40, 42, 44 receiving side arms 34, 36, 38 respectively and pivotally linked to side arms 34, 36, 38 by pin 50 passing through side wall 52, 54 of channel 48 and side arm 34, 36, 38.

Channel 48 at end opposite pin 50 receives vertically oriented segment 56 of top arm 40, 42, 44 and is permanently secured thereto preferably by means of a weld 58.

Side arm 34, 36, 38 may thereby extend from an erected 60 to a collapsed 62 position.

Figure 4:
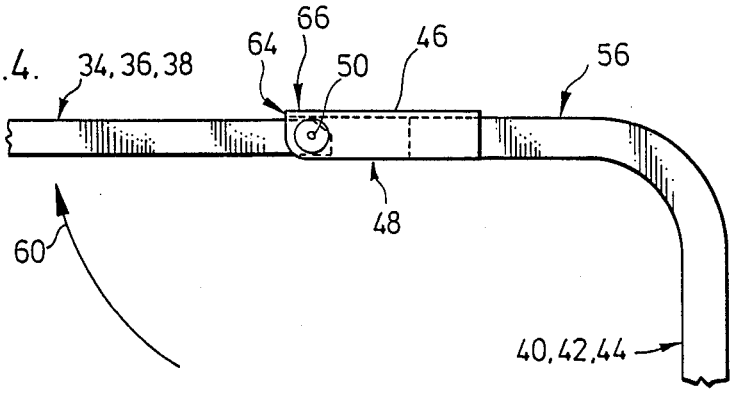
FIG. 4 is a side view of the joint shown in FIG. 3, shown in an erected position.

With reference to FIG. 4, it will be appreciated from a top view of the pivotal joint 46 that pin 50 is spaced from the end 64 of channel 48 sufficient to permit the back 66 of channel 48 to prevent side arm 34, 36, 38 from opening beyond erected position 60.

Figure 5:
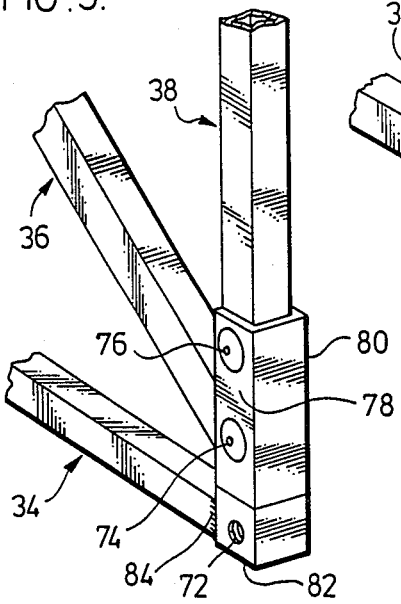
FIG. 5 is a close-up perspective partially cut away view of a joint providing three vertically spaced pivot points for the frame shown in FIGS. 2, 7, 8 and 9, shown in an erected position.
Figure 6:
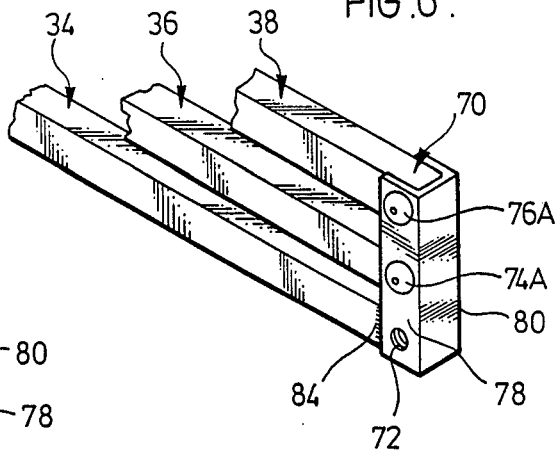
FIG. 6 is a view of the joint shown in Figure 5, shown in a collapsed position.
Figure 12:
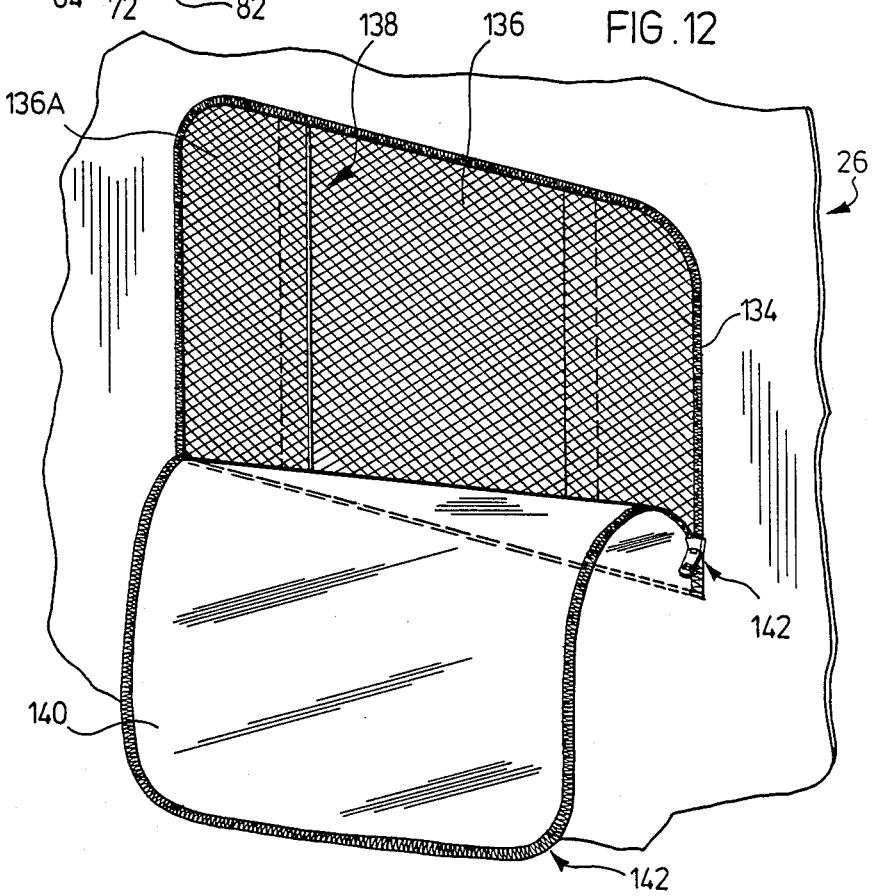
FIG. 12 is a perspective view shown from the inside of the portable shelter of the front screen and flap system shown in FIGS. 10 and 11.
Figure 7:
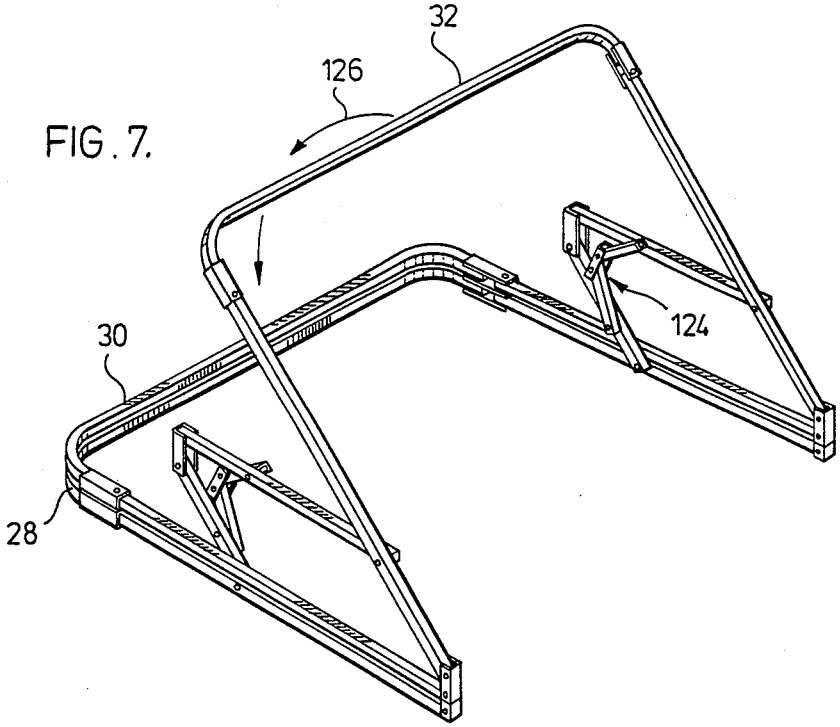
FIG. 7 is a perspective view of the frame shown in FIG. 2, shown in a partially collapsed position.
Figure 8:
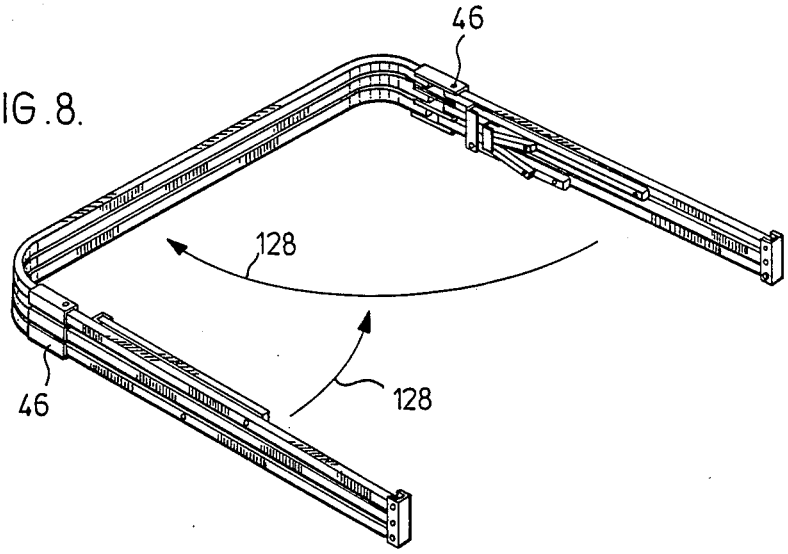
FIG. 8 is a perspective view of the frame shown in FIG. 2, shown in a partially collapsed position.
Figure 11:
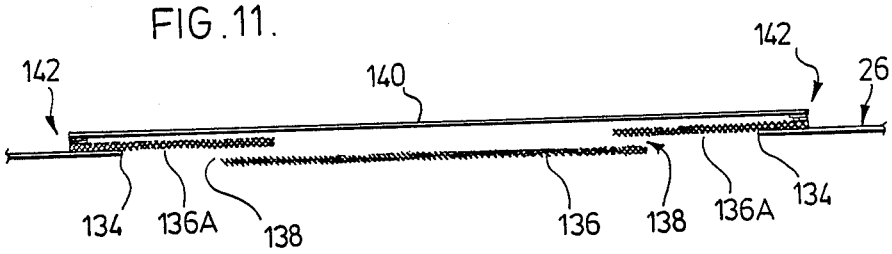
FIG. 11 is a top view of the front screen and flap system shown in FIG. 10.
Figure 13:
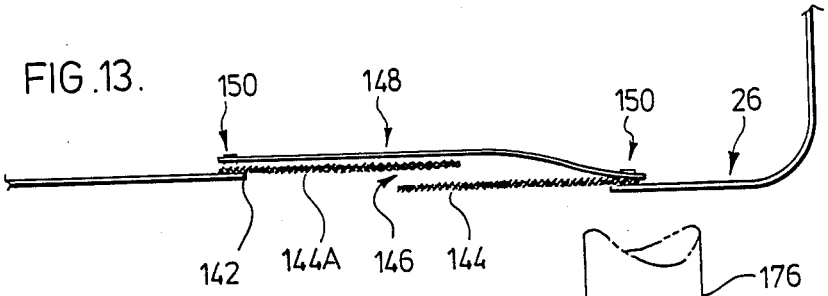
FIG. 13 is a top view of the side screen and flap system shown in FIG. 10.

With reference to FIGS. 2, 5 and 6, a frame member pivot joint 68 is provided. Pivot joint 68 stands upright and comprises a vertically oriented channel 70 (best shown in FIG. 6) opening towards frame members 28, 30, 32 and receiving vertically spaced ends of side arms 34, 36, 38; channel 70 carrying a plurality of at least two vertically spaced apertures 72, 74, 76 (one of which is shown at 72) through both of side walls 78, 80 defining the lateral extent of channel 70, whereby side arms 34, 36, 38 are pivotally linked to side walls 78, 80 of channel 70 by pin 74A, 76A passing through side walls 78, 80 and side arms 36, 38. Preferably, the end of side arm 34 of horizontal frame number 28 is secured inside base 82 of vertically oriented channel 70 by weld 84 and does not require a pin as seen with reference to side arms 36, 38 pivotally secured by pins 74A, 76A.

With reference to FIG. 6, it will be appreciated that pivotal points defined by pins 74A, 76A are vertically spaced to permit side arms 36, 38 to pivot from a substantially vertical to a substantially horizontal position. Accordingly, it will be appreciated that the ends of side arms 36, 38 are bevelled to permit pivotal rotation within channel 48.

With reference to FIG. 2, to releasably secure frame 24 in erected position, there is provided horizontal locking segment 86 pivotally attached to side arm 38 by pin 88; segment 86 at its opposite end carries a vertically oriented pivotal joint 90 (similar to pivotal joint 46) which is pivotally attached by pin 92 to vertical locking segment 94. Vertical locking segment 94 is pivotally attached to side arm 34 by pin 96. It will be appreciated that pivotal joint 90 is identical in structure to pivotal joint 46 and therefore provides a channel 98 opening towards horizontal locking segment 86. Channel 98 receives end of horizontal locking segment 86 and is welded thereto.

Horizontal locking segment 86 and vertical locking segment 94 are locked in angular relationship of substantially 90 degrees with respect to one another by a diagonal locking segment 100 composed of subsegments 102, 104. Subsegments 102, 104 are connected one to the other by a channel-shaped locking bar 106. Locking bar 106 comprises a channel surmounting and receiving ends of subsegments 102, 104 and pivotally linked thereto by pins 110, 112. Subsegments 102, 104 are pivotally linked to locking segments 94, 86 by pins 108, 114 respectively. It will be appreciated that locking segments 94, 86 support the angular relationship between frame side arms 34, 38; diagonal locking segment 100 secures locking segments 94, 86 at an angular relationship to one another of substantially 90 degrees.

With reference to FIGS. 2, 7, 8 and 9, it will be seen that when an angularly upward pressure along a vector 124 is applied to locking bar 106, diagonal locking segment 100 is collapsed permitting horizontal locking segment 86 and vertical locking segment 94 to pivot to a substantially parallel position with respect to one another; simultaneously, vertical frame member 32 is released and may collapse along curved vector 126 to a position substantially parallel with horizontal frame member 28. It will be appreciated that intermediate frame member 30 is only linked to frame 24 at aperture and pin 74, 74A; angular position of intermediate frame member 30 is secured by web of cover 26 extending between frame members 28, 30, 32 (best seen in FIG. 14). With regard to FIG. 8, horizontally collapsed side arms 34, 36, 38 may be pivoted at joints 46 along vectors 128 to fully collapse frame (best seen in FIG. 9). It will be appreciated that cover 26 is secured to frame by loops 130 zoned to cover 26 and extending around frame members or by pins 132 extending through cover 26 and frame members (best shown in FIG. 10), sufficiently that cover 26 substantially conforms to configuration of frame 24 when frame is either erected (FIG. 2) or fully collapsed (FIG. 9).

Figure 2A:
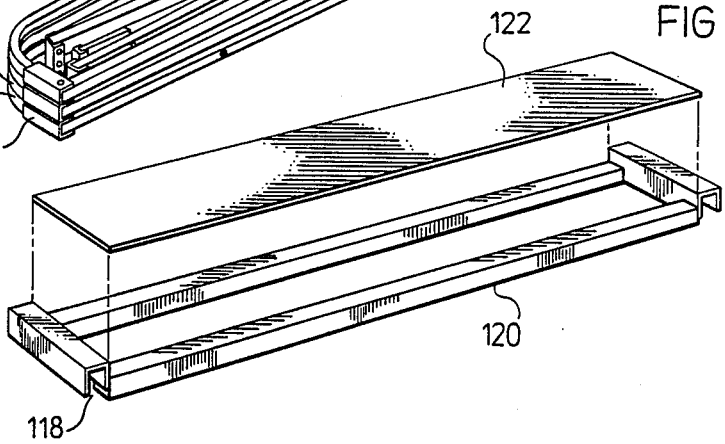
FIG. 2A is a top perspective partially exploded view of part of the seat shown in part of FIG. 2.
Figure 2B:
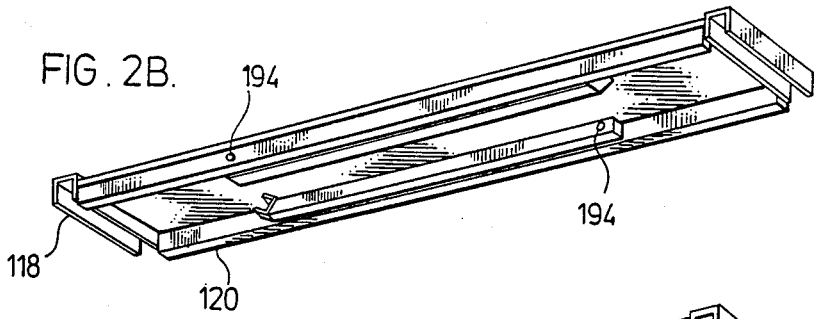
FIG. 2B is a lower perspective view of the seat shown in FIGS. 2, 2A, 2C, 2D depicting unextended lateral support arms.
Figure 2C:
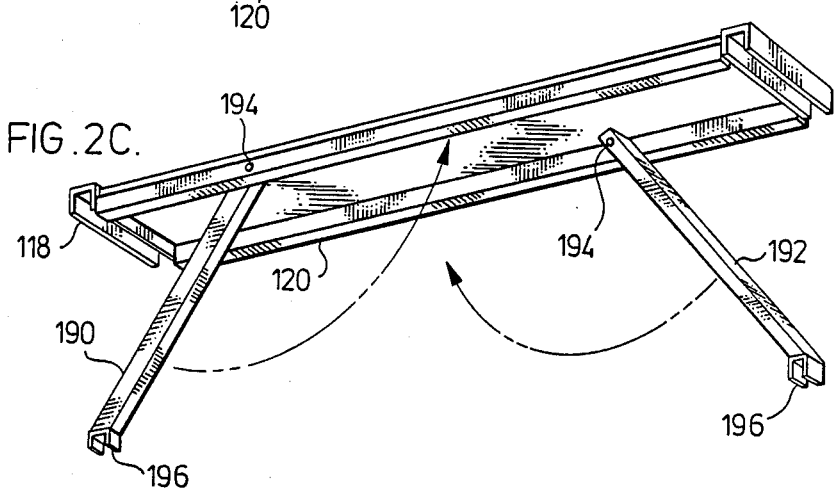
FIG. 2C is a lower perspective view of the seat shown in FIG. 2B, depicting extended lateral support arms.
Figure 2D:
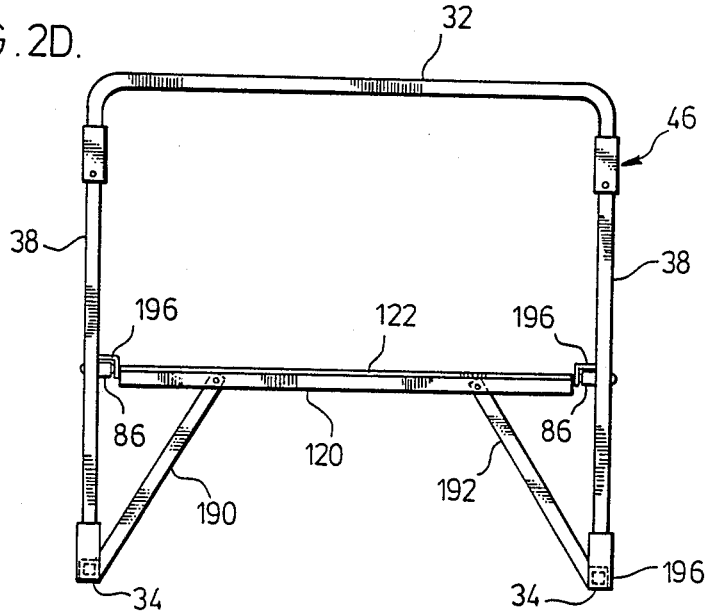
FIG. 2D is a side view taken along lines 2—2 (in FIG. 2) of a seat and frame depicting the seat laterally supporting the elements of the frame in spaced relationship.

With reference to FIGS. 2A, 2B and 2C, it will be seen that seat 116 comprises downwardly oriented channels 118 spaced apart by and welded to support bars 120 which carry pivotally connected lateral support arms 190, 192. Support bars 120 carry on overlying seat cushion or board 122. Channels 118 are of dimensions suitable to frictionally surmount horizontal locking segments 86. Lateral support arms 190, 192 pivot in relation to support bars 120 by means of a pin 194 and at the opposite end carry downwardly oriented channels 196 of dimensions suitable to frictionally surmount horizontal side arms 34. With reference to Figures 2 and 2D, seat 22 comprising extended lateral support arms 190, 192 surmounting horizontal side arms 34 and channels 118 surmounting horizontal locking segments 86 is essential so as to substantially stabilize the lateral stability of pivotally collapsible self-supporting frame 24 while erected.

Figure 10:
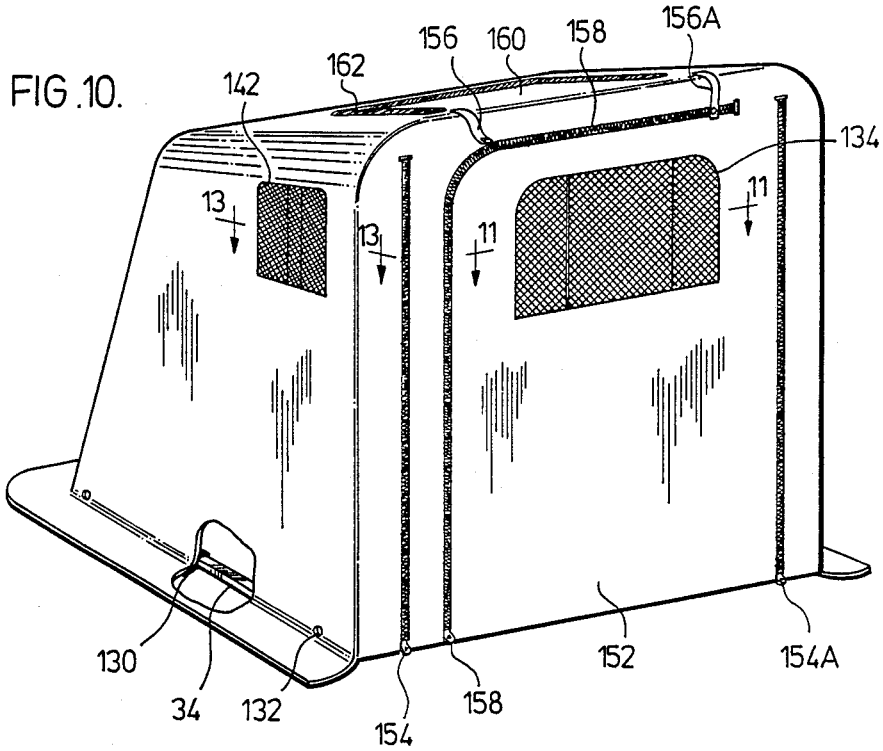
FIG. 10 is a perspective view of one embodiment of the portable shelter.

With reference to FIG. 10, 11, 12, and 13, a frame 24, cover 26 therefor and a system of flaps, screens and windows for cover 26 are shown in one embodiment preferably suitable as an outdoor portable shelter; for example, hunting blind. Front aperture 134 comprises a fine webbing or screen 136 sewn into aperture 134 in cover 26 constructed of at least two overlapping pieces of webbing 136, 136A to provide slits 138 which may be ideally spread apart by hand or pressure from the muzzel of a firearm. Inside front flap 140 releasably overlies screen 136, 136A by closing zipper 142 communicating between flap 140 and circumference of aperture 134. Side aperture 142 comprises a fine webbing or screen 144, 144A sewn into aperture 142 in cover 26 constructed of at least two overlapping pieces of webbing 144, 144A to provide slit 146; inside side flap 148 overlies screen 144, 144A by closing zipper 150 communicating between flap 148 and circumference of aperture 142. It will be appreciated that flaps 140, 148 form a waterproof seal with cover 26; and that as many embodiments of apertures 134, 142 as necessary may be finished into cover. With reference to FIG. 10, front door 152 may be rolled up by unzipping vertically oriented zippers 154, 154A and securing door 152 with ties 156, 156A (best shown in FIG. 1). Door 152 may be unzipped to provide an open flap of controlled aperture by employing a vertically and horizontally oriented zipper 158.

As many embodiments of door 152 as necessary may be finished into cover 26; to waterproof flap 160 is shown in FIG. 10, comprising inwardly opening flap 160 and zipper 162.

Figure 15:
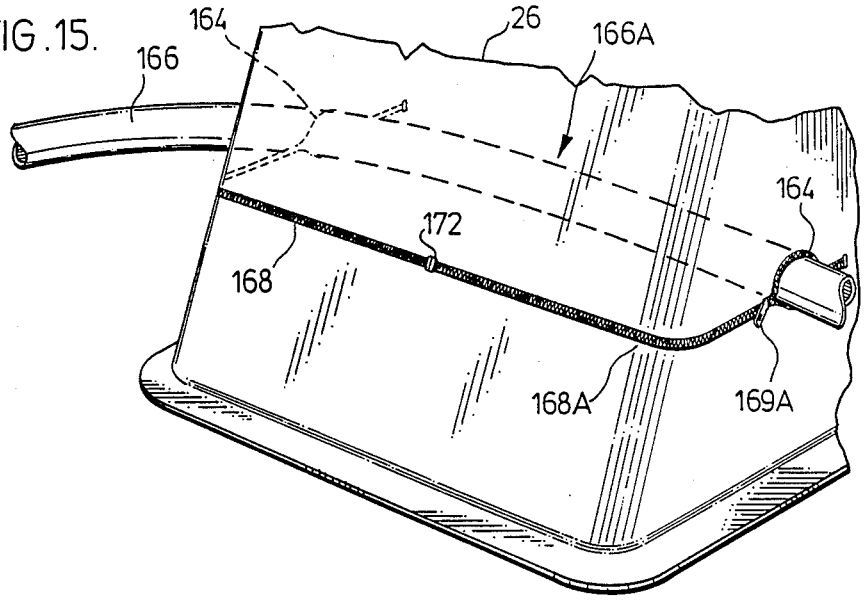
FIG. 15 is a close-up perspective partially cut away view of a portion of the portable shelter shown in FIG. 14 surrounding a cable.
Figure 14:
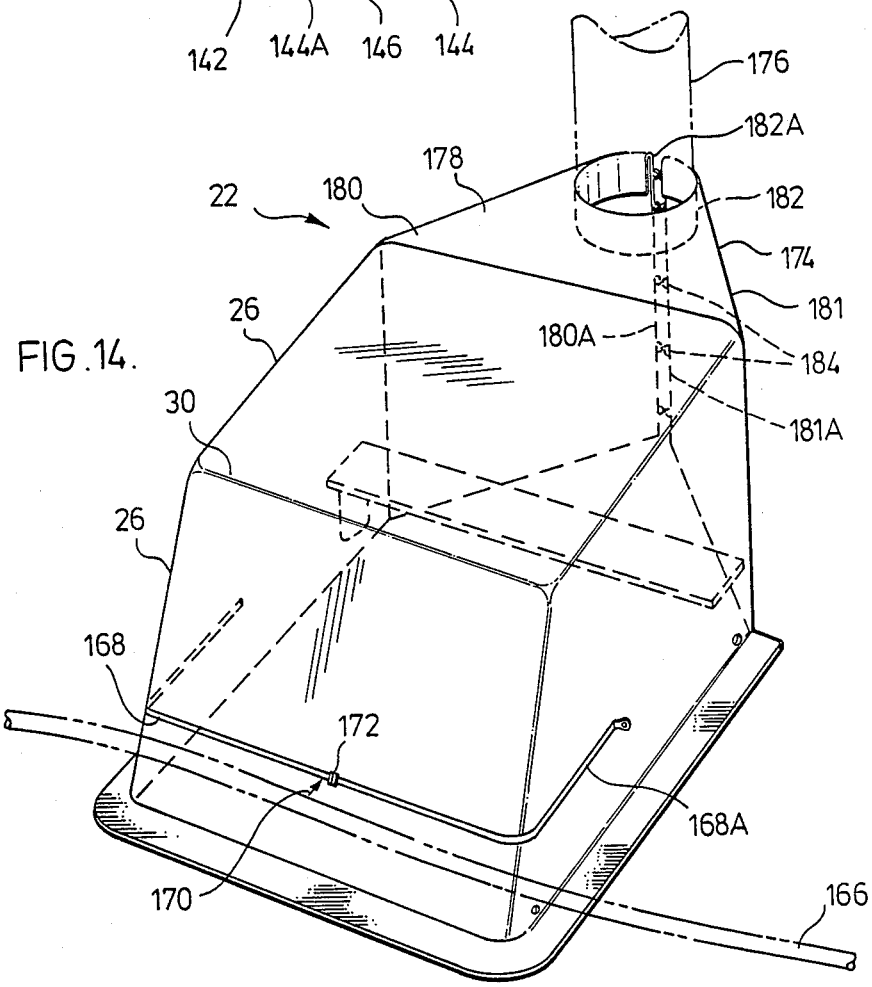
FIG. 14 is a perspective view of one embodiment

With reference to FIGS. 14 and 15, a frame 24, cover therefore 26, and a system of flaps, collars and zippers for cover 26 are shown in another embodiment preferably suitable as a portable shelter outdoors or indoors (for example, in an underground hydro vault) in effecting electrical or telephone field repairs particularly in the case of electrical components including integrated circuits or switches, fibre optics, cables, or digital equipment where the equipment must be worked upon in a protected environment free of dust, corrosive contaminants, rain or snow etcetera. Horizontally extending aperture 164 (best shown in FIG. 15) for electrical cable 166 passing longitudinally through cover 26 comprises two sections of a horizontally extending zipper 168, 168A which may be opened to provide a cross-sectional horizontally extending slit 170 to receive longitudinally extending cable 166, and zipped closed behind cable 166 to enclose section 166A of cable 166 to be worked on in cover 26. It will be appreciated that sliding pieces 169, 169A of zipper sections 168, 168A may be reciprocated to central clasp 172; sliding piece 169, 169A reciprocates towards central clasp 172 upon upper or lower strip of teeth and thereby passes over cable 166 once cable 166 is inserted in cross-sectional slit 170 proximate aperture 164. Sliding piece 169, 169A joins clasp 172 and closes slit 170 behind cable 166 by drawing upper and lower strips of teeth into interlocking position.

Enclosure 174 for a vertically extending pole 176 comprises a plurality of top 178 and side 180, 181 flaps extending outwardly from front of shelter 22 defined by vertical frame member 32. Top enclosure flap 178 carries a vertically extending collar 182 of sufficient circumference to extend around circumference of pole 176. Vertically extending edges of collar 182A and side flaps 180A, 181A are jointed by a plurality of any suitable fasteners 184 to complete enclosure 174, thereby providing a protected environment around electrical components carried by pole 176 proximate its base.

As many changes can be made to the embodiment of the invention without departing from the scope of the invention, it is intended that all material be considered illustrative of the invention and not in a limiting sense.

The embodiments of the invention in which an exclusive property or privilege is claimed are as follows:

1. For a portable self-supporting collapsible shelter having a supporting frame, a cover comprising when erected upon said frame a tent enclosure having at least two side walls, a top wall, and a front wall; the cover having at least one continuous opening slit directed across at least two adjacent walls, the at least one continuous opening slit when open providing a mouth having an upper lip and a lower lip which are separable and which extend to two remotely spaced edges of the mouth, the at least one continuous opening slit being closed and opened by closure means, the said mouth when open suitable to receive at least one section of a cable longitudinally passing through the tent enclosure, said at least one section of cable receivable into the said tent enclosure through the mouth to the extent of the two remotely spaced edges of the mouth, the closure means in use for joining the upper lip and the lower lip to proximate the two remotely spaced edges of the mouth sufficient to form two apertures, one aperture proximate each edge of the mouth; whereby in use the mouth is substantially closed by the closure means so as to enclose the at least one section of cable in the tent enclosure and form two apertures about the section of cable, one aperture proximate each edge of the mouth; and whereby the mouth may be opened to permit removal of the at least one section of cable from the tent enclosure.

2. For a portable self-supporting collapsible shelter having a supporting frame, a cover comprising when erected upon said frame a tent enclosure having at least two side walls, a top wall, and a front wall; the cover having at least one continuous opening slit directed across at least two adjacent walls, the at least one continuous opening slit when open providing a mouth having an upper lip and a lower lip which are separable and which extend to two remotely spaced edges of the mouth, the at least one continuous opening slit being closed and opened by continuous closure means, the said mouth when open suitable to receive at least one section of a cable longitudinally passing through the tent enclosure, said at least one section of cable receivable into the said tent enclosure through the mouth to the extent of the two remotely spaced edges of the mouth, the continuous closure means in use for joining the upper lip and the lower lip to proximate the two remotely spaced edges of the mouth sufficient to form two apertures, one aperture proximate each edge of the mouth; whereby in use the mouth is substantially closed by the continuous closure means so as to enclose the at least one section of cable in the tent enclosure and form two apertures about the section of cable, one aperture proximate each edge of the mouth; and whereby the mouth may be opened to permit removal of the at least one section of cable from the tent enclosure.

3. For a portable self-supporting collapsible shelter having a supporting frame, a cover comprising a tent enclosure when erected upon said frame and having at least two parallel side walls spaced from each other by an intermediate rear wall, a top wall, and a front wall; the cover having at least one continuous opening slit directed across at least two adjacent walls, the at least one continuous opening slit when open providing a mouth having an upper lip and a lower lip which are separable and which extend to two remotely spaced edges of the mouth, the at least one continuous opening slit being closed and opened by closure means, the said mouth when open suitable to receive at least one section of cable longitudinally passing through the tent enclosure, said section of cable receivable into the said tent enclosure through the mouth to the extent of the two remotely spaced edges of the mouth, the closure means in use for joining the upper lip and the lower lip to proximate the two remotely spaced edges of the mouth sufficient to form two apertures, one aperture proximate each edge of the mouth; whereby in use the mouth is substantially closed by the closure means so as to enclose the at least one section of cable in the tent enclosure and form two apertures about the least one section of cable, one aperture proximate each edge of the mouth; and whereby the mouth may be opened to permit removal of the at least one section of cable from the tent enclosure.

4. For a portable self-supporting collapsible shelter having a supporting frame, a cover comprising a tent enclosure when erected upon said frame and having at least two parallel side walls spaced from each other by an intermediate rear wall, a top wall, and a front wall; the cover having at least one continuous opening slit directed across at least two adjacent walls, the at least one continuous opening slit when open providing a mouth having an upper lip and a lower lip which are separable and which extend to two remotely spaced edges of the mouth, the at least one continuous opening slit being closed and opened by continuous closure means, the said mouth when open suitable to receive at least one section of cable longitudinally passing through the tent enclosure, said section of cable receivable into the said tent enclosure through the mouth to the extent of the two remotely spaced edges of the mouth; whereby in use the mouth is substantially closed by the continuous closure means so as to enclose the at least one section of cable in the tent enclosure and form two apertures about the at least one section of cable, one aperture proximate each edge of the mouth; and whereby the mouth may be opened to permit removal of the at least one section of cable from the tent enclosure.

5. For a portable self-supporting collapsible shelter having a supporting frame, a cover comprising a tent enclosure when erected and supported by the frame having at least two side walls spaced from each other at the same ends by a rear wall, a top wall (or roof) and a front wall the cover having at least one continuous opening directed across one first wall and at least partially across two other walls spaced from each other at the same ends by the one first wall, in use said at least one continuous opening being closed and opened by at least one continuous closure means being disengageable so as to open the at least one continuous opening and being engageable so as to close the at least one continuous opening, enclosing an article traversing the at least one continuous opening.

6. For a portable self-supporting collapsible shelter having a supporting frame, a cover comprising a tent enclosure when erected and supported by the frame having at least two side walls spaced from each other at the same ends by a rear wall, a top wall (or roof) and a front wall the cover having at least one continuous opening directed across one first wall and at least partially across two other walls spaced from each other at the same ends by the one first wall, in use said at least one continuous opening being closed and opened by at least one zipper being disengageable so as to open the at least one continuous opening and being engageable so as to close the at least one continuous opening, enclosing an article traversing the at least one continuous opening.

* * * * *